US005487464A

United States Patent [19]

Galbierz et al.

[11] Patent Number: 5,487,464

[45] Date of Patent: Jan. 30, 1996

[54] PAPERBOARD CARRIER WITH CONTAINER RELEASE PROVISION

[75] Inventors: Richard T. Galbierz; Michael A. Galbierz, both of St. Louis, Mo.

[73] Assignee: Imperial Packaging, Inc., St. Louis, Mo.

[21] Appl. No.: 282,778

[22] Filed: Jul. 29, 1994

Related U.S. Application Data

[63] Continuation-in-part of Ser. No. 170,012, Dec. 20, 1993, abandoned.

[51] Int. Cl.[6] ..... B65D 75/00

[52] U.S. Cl. ..... 206/149; 206/152; 206/158

[58] Field of Search ..... 206/145, 146, 206/147, 148, 149, 151, 152, 153, 158, 161, 427; 294/87.2

[56] References Cited

U.S. PATENT DOCUMENTS

| | | | |
|---|---|---|---|
| 2,298,209 | 10/1942 | Gray | 224/45 |
| 2,437,667 | 3/1948 | Smith | 294/87 |
| 2,997,169 | 8/1961 | Poupitch | 206/65 |
| 3,038,602 | 6/1962 | Rapata | 206/65 |
| 3,086,651 | 4/1963 | Poupitch | 206/65 |
| 3,137,109 | 6/1964 | Rapata | 53/48 |
| 3,156,377 | 11/1964 | Wysocki | 206/158 X |
| 3,331,500 | 7/1967 | Poupitch | 206/65 |
| 3,897,873 | 8/1975 | Graser | 206/153 |
| 4,064,989 | 12/1977 | Olsen | 206/428 |
| 4,109,787 | 8/1978 | Klygis et al. | 206/150 |
| 4,305,500 | 12/1981 | Jaeschke | 206/158 X |
| 4,465,180 | 8/1984 | Klygis | 206/151 X |
| 4,925,020 | 5/1990 | Gordon | 206/150 |
| 5,020,661 | 6/1991 | Marco | 206/150 |
| 5,102,971 | 4/1992 | Schuster | 206/153 |
| 5,139,137 | 8/1992 | Marco | 206/150 |
| 5,186,321 | 2/1993 | Fadus | 206/151 |
| 5,193,673 | 3/1993 | Rathbone et al. | 206/150 |
| 5,209,346 | 5/1993 | Pratt et al. | 206/150 |
| 5,255,780 | 10/1993 | Olsen | 206/150 |

*Primary Examiner*—Jacob K. Ackun
*Attorney, Agent, or Firm*—Polster, Lieder, Woodruff & Lucchesi

[57] ABSTRACT

A paperboard carrier for containers arranged in the carrier in side-by-side positions with the carrier formed with apertures to receive the filling ends of the containers in which the apertures are delineated by embossed ring formations, each one surrounding a group of tabs radiating inwardly from the ring formation to terminal ends which are shortened to leave an open space. One of the group of tabs in each aperture is formed with an enlarged inner end to substantially fill the space left by the terminal ends of the other tabs. The group of tabs in each of the embossed ring formations close the aperture but are responsive to the insertion of a container filler end to hinge outwardly on the embossed ring formation into a conic shape to engage the container filling end, with the special feature of the one tab hinging outwardly to position its enlarged inner end alongside the container for easy grasping to tear that one tab out of the paperboard for effectively releasing the container.

21 Claims, 8 Drawing Sheets

PAPERBOARD CARRIER WITH CONTAINER RELEASE PROVISION

This application is a continuation-in-part of application Ser. No. 08/170,012, filed Dec. 20, 1993 now abandoned.

FIELD OF THE INVENTION

This invention is directed to improving the release of containers packaged in biodegradable paperboard carriers which are rendered environmentally safe when discarded.

DESCRIPTION OF THE PRIOR ART

It is known in U.S. Pat. No. 3,038,602 of Jun. 12, 1962 to provide a flat plastic sheet type carrier for containers in the can class to at least partially release or loosen the containers prior to complete removal from the carrier. A further development in the packaging of beverage containers in sheets of paperboard material has encountered a problem of holding the containers as they are difficult to remove from the carrier. This problem is discussed in U.S. Pat. 3,137,109 of Jun. 16, 1964.

A further U.S. Pat. 2,997,169 of Aug. 22, 1961 is known to provide a container-carrier device which tenaciously retains cans or other containers, but which is readily severable to release the containers as desired. The carrier device is formed of a sheet of plastic material in which tabs can be formed to be torn out to release cans. Still further there is U.S. Pat. No. 3,331,500 of Jul. 18, 1967 for packaging articles to protect the peripheral bead of containers against sustaining nicks or burrs and simultaneously insulates adjacent containers. When packaged in groups of three containers, tear strips are provided in the article cover means.

In the field of container bottles packaged in carriers, it is known in U.S. Pat. No. 2,298,209 of Oct. 6, 1942 to use a paper or cardboard or other inexpensive material which needs to be folded from its flat condition to a carrier position when required. Still further in U.S. Pat. No. 2,437,667 of Mar. 9, 1948 there is disclosed a carrier of heavy paper sack or paste-board consisting of a main frame having holes to receive the beaded necks of bottles, and in which the main frame has slidable plates that are moved by a handle to engage the necks of bottles for carrying purposes.

SUMMARY OF THE INVENTION

The invention to be disclosed and claimed is directed to a biodegradable paperboard carrier which forms a simple and inexpensive package for securing a group of containers by the neck ring while making it easy to release the containers one at a time.

An important object is to select material that has the necessary strength to support a group of containers and is wildlife-friendly and biodegradable.

A further object of the invention is to provide a paperboard carrier that possesses secure engagement with the individual containers and easily releases each container by tearing a tab especially adapted to make a container easy to release.

A further object is to produce a container carrier product from paperboard that is inexpensive to produce allows for easy release of the containers from the carrier and eliminate most of the scrap paper in production.

Another object is to produce container carriers from paperboard that are capable of supporting the weight of a group of containers and possess stiffness as well as strength.

Other objects and advantages of the invention will be set forth in the following description of representative drawings which illustrate the best mode which the invention can possess.

BRIEF DESCRIPTION OF THE DRAWINGS

In the following drawings the best mode for the structure is as follows.

DETAIL DESCRIPTION OF THE EMBODIMENTS

Figure 1:
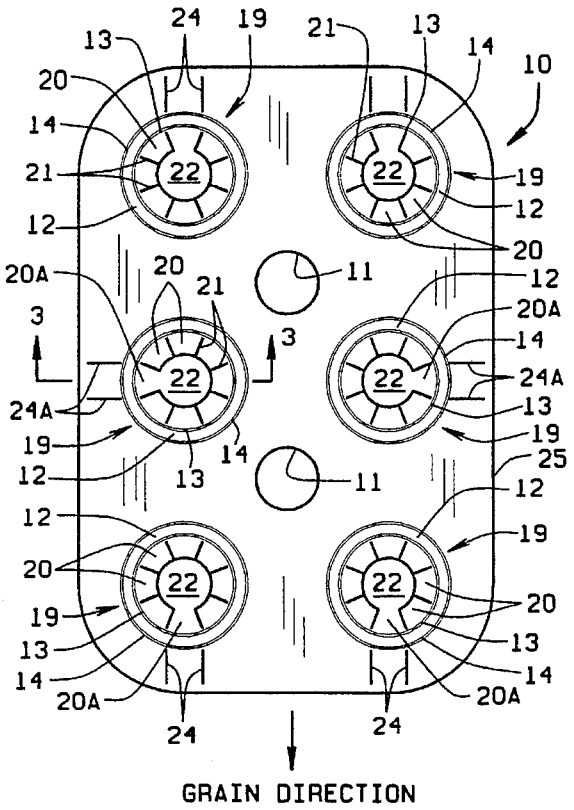
FIG. 1 is a plan view of a carrier for containers in which biodegradable paperboard is stamped out for a popular packaging of containers in a six-pack group in which two of the container release tabs lift out of the paperboard transverse to the grain direction.

The embodiments of the invention are constructed to disclose the preferred form in the field where containers can be easily packaged in six-pack carrier groups which secure each container by its container filling end against unintentinal separation from the carrier, but which can be released by the tearing of a tab out of the container carrier for releasing containers one at a time. In order to obtain the secure arrangement of containers in a six-pack and the easy release of each container, the carrier is formed of paperboard stamped out in the flat form to provide precise locations for each container. The precise locations have a plurality of tabs lying in the plane of the paperboard and being radially directed to project inwardly from the circumferential margin of a container receiving aperture which appears in flat form with a circular center area integrally connected to one of the radially directed tabs.

When a carrier board is stamped out in a flat form, the placement of the carrier board over the filler ends of the containers will cause the radially inwardly directed tabs to blossom out in a cone shape form to surround each of the container filler end neck rings and provide a secure support for the containers. As the radial tabs blossom out one special tab is selected to remain integral with the circular central area and capable of being forced outwardly by the insertion of the container filler cap into the aperture remaining when all tabs blossom into a conic configuration. That one special tab carries the integral circular area out of the carrier board to take a position along side the filler end of each container to be transformed into a pull tab capable of being pulled up from the carrier board to weaken the circular array of support tabs so the containers can be easily released. As a result, the stamped carrier board produces the desired apertures for the containers without producing any scraps of material for discard.

The one special tab is hingedly connected to the carrier board at its outer end by the formation of a preformed circumferentially directed embossment, and the surface of the carrier board between the embossed ring and the outer edge of the carrier board is formed with slits, serrations or scores to define a part of the carrier board to be ruptured on pulling the tab out of the board to form the container release gap for the aperture. The creation of the release gap weakens the ability of the remaining tabs to keep a secure support on the container. The result of the container release gap formation allows the container to be swung outwardly in the direction of the gap to easily deform enough of the tabs to release their support on the container.

The character of paperboard that will allow for tearing out a strip of the paperboard clean through the paperboard sheet should be ideally solid, rather than combined with other lighter weight sheet material. Further, the paperboard must have a degree of rigidity which is related less to material strength and more to the sectional modulus of the structure, such as double thickness which quadruples the stiffness in the flat form, or adding stiffness by folded-down side panels, in a form to appear presently. Difference in machine-direction and cross-machine-direction paper strength can determine the orientation of tear strips. If the orientation of the tear strips runs parallel with the machine-direction in the paper board the difference in strength along the two axes will result in easier tearing of the paper strips running in the machine direction.

Figure 2:
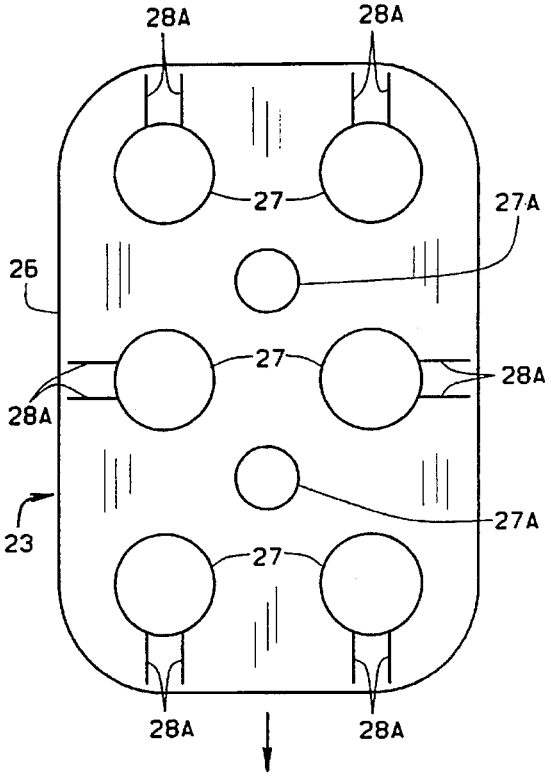
FIG. 2 is a plan view of a paperboard ply for stiffening the resulting carrier of FIG. 1 showing a similar orientation of the apertures to agree with FIG. 1.

The embodiment of the carrier paperboard seen in FIGS. 1–4 is characterized with the paperboard grain direction substantially parallel to the lengthwise shape of the carrier, as in FIGS. 1 and 2. In FIG. 1 the board 10 is a solid ply which is stamped out to have finger holes 11 which can serve also as board position locators for any subsequent operations. Having located the board 10, stamping dies will be used to form six apertures 19, on the top face, each of which will be formed by a circular embossment 12 having (FIG. 3) depressions 13 and 14 with a raised surface 15 between these depressions. The bottom surface of the embossment has a single depression 16 opposite to the top face raised surface and a pair of raised surfaces 17 and 18. The series of apertures 19 lie within the circular embossments 12 and are identified by a circumferential series of tab elements 20 which are separated by radially inwardly directed score lines 21 which end at a central circular element 22 located within the center of each embossment 12. That center circular element 22 is integral with a special one of the tab elements 20A. Each tab element 20A is integral with a central element 22. This shape of the tabs defines and initially fills the aperture within the circular embossment 12.

When the paperboard carrier 23 of FIG. 2 is to be laminated to paperboard 10 of FIG. 1 to support a group of six containers (see FIG. 10) in the form of bottles B with filler caps C in place over container neck rings R, the caps C penetrate the apertures 19 in the embossment rings 12 and cause the tabs 20 to pivot on the inner depression 13 of the adjacent embossment and deflect upwardly at an angle that is initially large enough to allow a cap C to pass through the resulting aperture 19. That initial upward pivoting of the tabs 20 and 20A connected to the element 22 takes place at the hinge depression 13. That hinging action of the element 20A raises the center element 22 up to lie along side of the container cap C (again see FIG. 10) so that all container release tabs 20 but the one tab 20A serve to engage under the container neck ring R which is sufficient to obtain a secure grasp of the container. When a container is to be released from the carrier 10, a pull on the element 22 with sufficient force will cause the tab 20A to tear through the embossment 12. By forming parallel scores 24 extending from the outer edge of embossment 12 to within a distance just short of penetrating the border edge 25 of the carrier 10 and border 26 of sheet 23, the tab 20A can tear through the border edges 25 and 26. This mutilation of the edges 25 and 26 of the paperboard carrier will weaken the security of the two closest tabs 20 which then weakens the holding strength of the remaining tabs 20. The result is that the container is released from any security support in the carrier 10 and 23 so it can be easily withdrawn.

In FIG. 1, the pair of apertures at each end of the carrier board 10 are associated with tear scores 24 running parallel to the grain direction of the carrier board. Because of the easier tearing direction of the paperboard, it makes the release of containers in those apertures easier than for the containers in the center two apertures which have tear scores 24A at right angles to the grain direction for the carrier board of the first embodiment.

Figure 3:
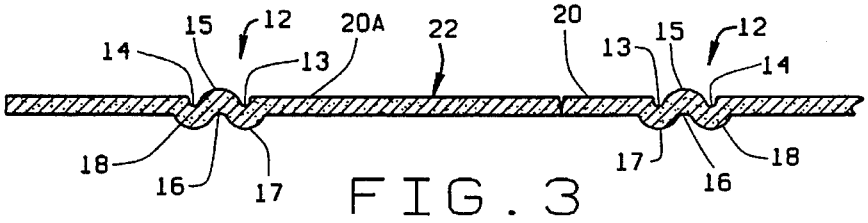
FIG. 3 is a fragmentary section view taken along line 3—3 in FIG. 1 to show the shape of the corrugated embossment around the aperture and the formation of a typical pull-tabs for releasing a container from the paperboard carrier.
Figure 4:
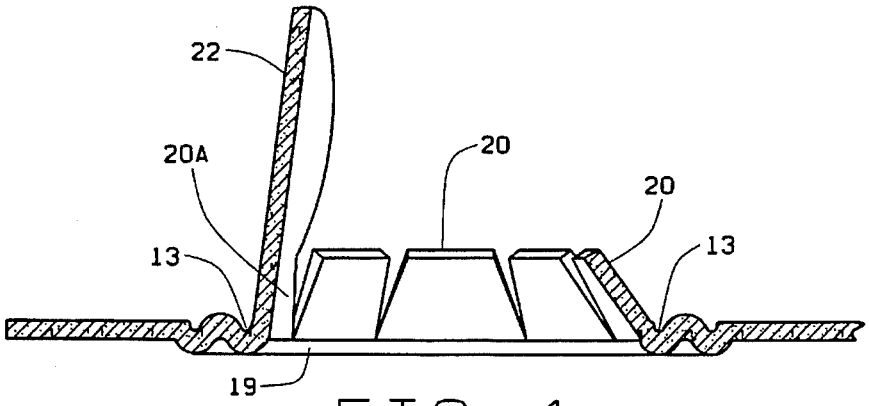
FIG. 4 is a view similar to FIG. 3 with the pull tab lifted from the paperboard to illustrate the hinging action, and showing the neck ring engaging tabs raised to positions about equivalent to the proper angle for supporting a container.

The foregoing description can be understood from the drawing FIGS. 1, 3 and 4. If a stiffened carrier is desired, due to weight of a complement of six containers, the carrier board 10 can be easily stiffened by being laminated to a sheet 23 seen in FIG. 2. The sheet 23 to be laminated is the same size in area as the carrier board 10. The difference lies in the sheet 23 having stamped out apertures 27, and finger holes 27A. The large apertures 27 are larger in size than the size of the aperture area inside the location defined by the embossment rings 12. Also, the respective laminate apertures 27 have tear scores 28A in pairs for the two end pairs of apertures 27, while the center apertures 27 have pairs of tear scores 28A directed across the grain direction, as in the carrier board 10.

Another embodiment of the invention is disclosed in FIGS. 5 to 8 in view of the position of feed of the paperboard carrier with its long dimension transverse to the feed direction. This embodiment has the paper grain direction oriented so the direction of tear out of the container release tabs is parallel to the grain direction.

Figure 5:
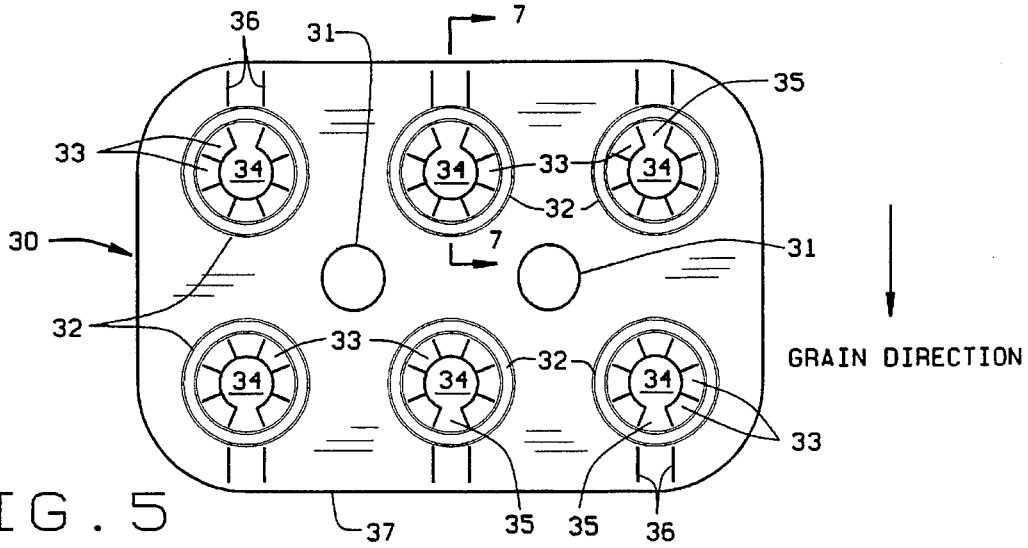
FIG. 5 is a plan view of a carrier with the tabs formed to be in positions so that they can be lifted out of the carrier paperboard in the grain direction.
Figure 7:
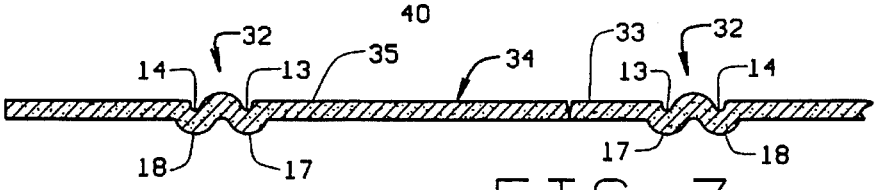
FIG. 7 is a fragmentary section view taken along line 7—7 in FIG. 5.
Figure 8:
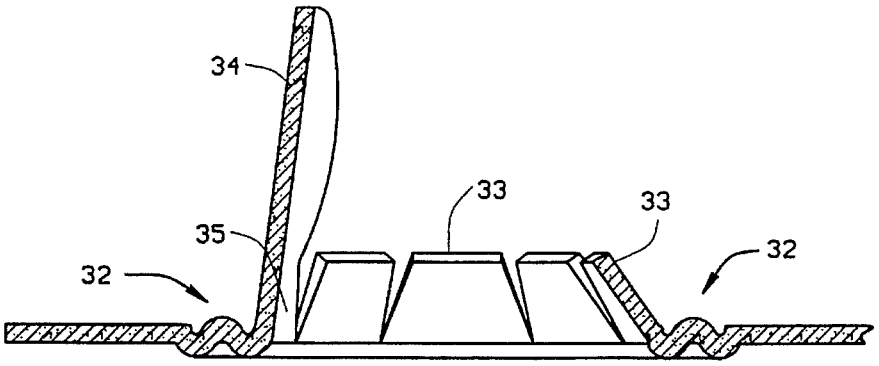
FIG. 8 is a view similar to FIG. 7 with a pull tab lifted from the paperboard to illustrate the hinging action when a container neck (not shown) has displaced the tabs.
Figure 10:
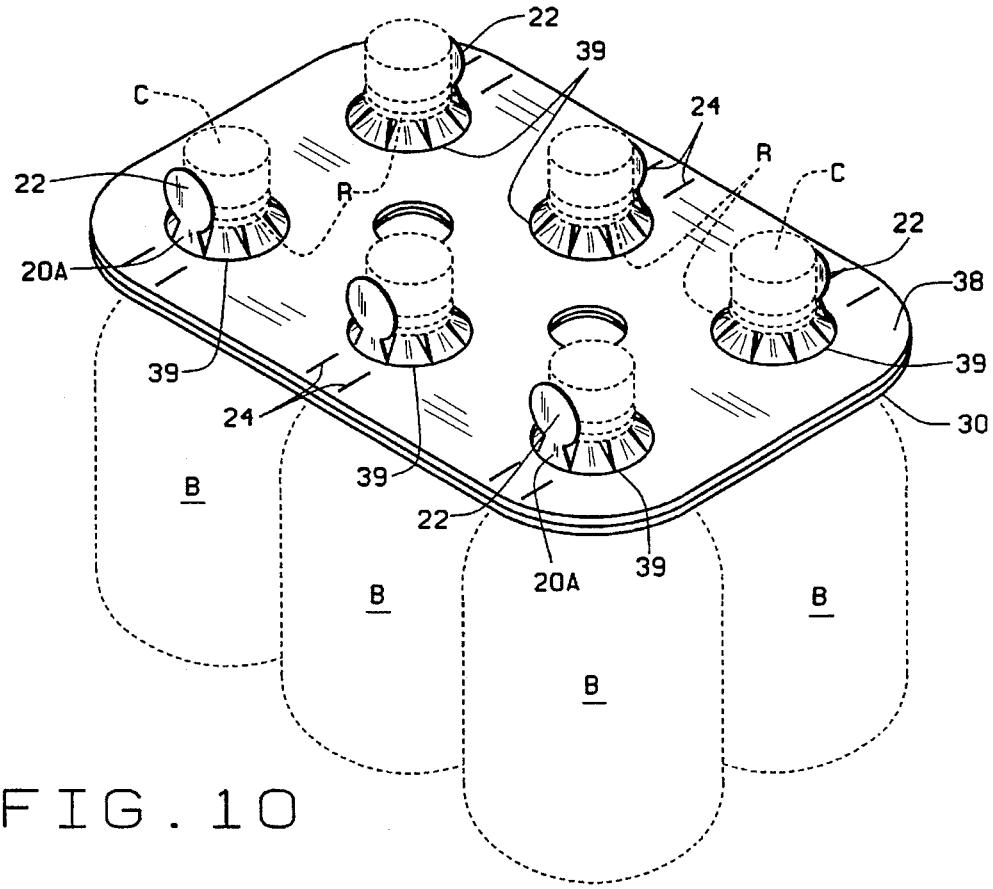
FIG. 10 is a perspective view of a six pack of containers in position in a paperboard carrier to illustrate a typical assembly with a laminated paperboard carrier.

Accordingly, the paperboard carrier 30 of FIG. 5 is formed with finger openings 31 for carrying the paperboard when loaded with a complement of six containers. The containers are positioned with the capped filler ends in each of the six apertures defined by circular embossments 32. The apertures are closed by a series of radially inwardly directed tabs 33 which surround a center disc 34 integrally formed with a single tab element 35 that is connected to the circular embossments 32 as shown in FIGS. 7 and 8. In the condition of the paperboard carrier 30 seen in FIG. 5, the tabs 33, the center disc 34 and its tab element 35 all are flush in the plane of the carrier 30. When that carrier is depressed over a six-pack of containers B, as illustrated in FIG. 10, the tabs 33 of FIG. 5 are caused to blossom upwardly to allow the container cap C to pass through the apertures defined by the circular embossments 32, and at the same time, the center discs 34 are pushed upwardly causing its tab elements 35 to pivot at a short length of the embossment 32 which acts as a hinge. The surfaces of the paperboard adjacent to the tear out elements 35 have been scored along spaced lines 36 to make it relatively easy to grasp the discs 34 and pull the elements 35 through the marginal edge 37 of the paperboard 30. The grain direction of the paperboard 30 and the direction of the score lines 36 are parallel so the tearing is easiest.

Figure 6:
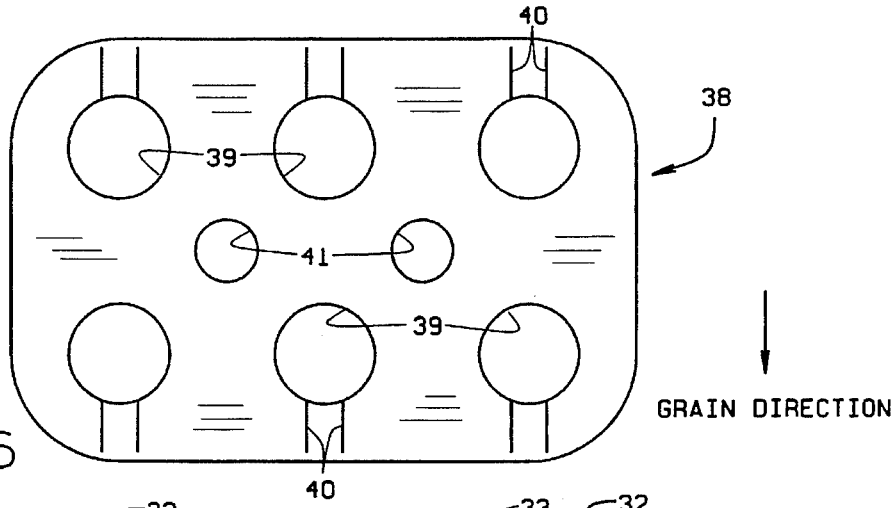
FIG. 6 is a plan view of a paperboard ply for stiffening the carrierboard of FIG. 5.

When the paperboard carrier 30 is used as a single solid ply, as in FIG. 5, the stiffness may be inherently sufficient to suspend the six containers when carried by fingers in apertures 31. However, when greater stiffness is needed, a paperboard ply, shown at 38 in FIG. 6, is laminated to the carrier 30. The applied laminate ply 38 is formed with a complement of apertures 39 to match the circular embossment 32 in the ply 30, and tear out scores 40 are also formed to match the score lines 36 of FIG. 5. In addition matching finger apertures 41 are formed. The direction of the score lines 40 is parallel with the grain direction of the paperboard 38 to make tearing easy.

The hinging action provided by the embossments 12 and 32 is best shown in FIGS. 4 and 8. The forming of indentations 13 and 14 raise concentric protrusions 17 and 18 on the reverse surface of the paperboard carrier 10 or 30 as in FIGS. 3 and 7.

Figure 9:
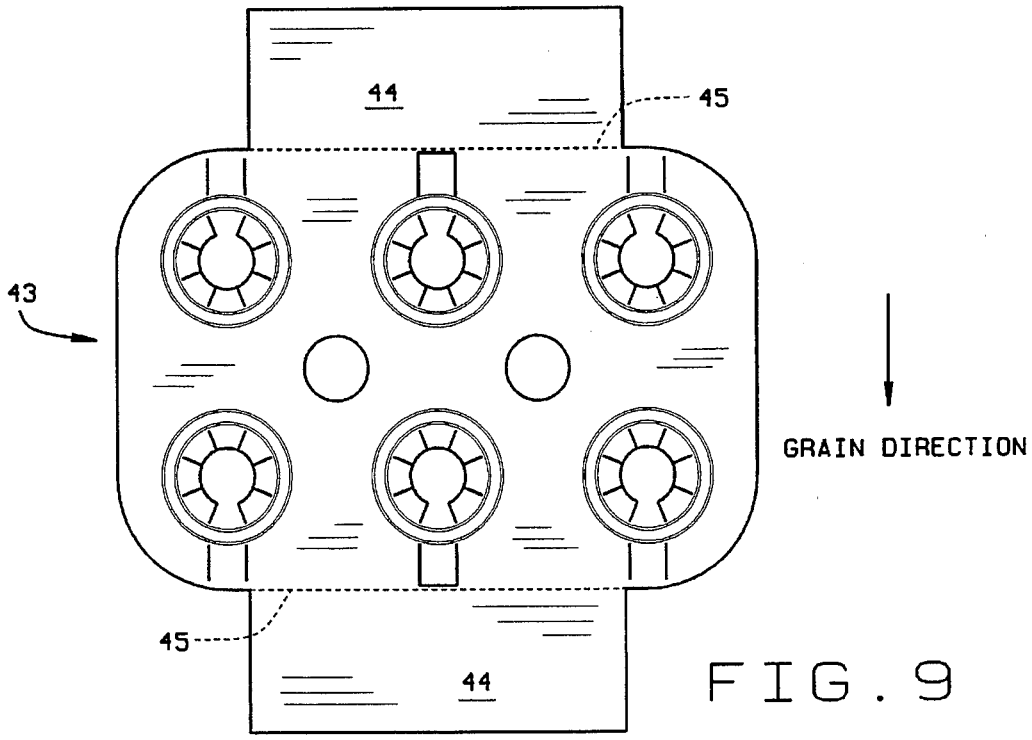
FIG. 9 is a plan view in flat position to show a paperboard carrier of the character seen in FIG. 5 to depict message carrying panels to describe, for example, the container contents.

The view of FIG. 9 illustrates a modified paperboard carrier 43 which is like the paperboard carrier 30 of FIG. 5, the difference is that the paperboard carrier 43 is formed with panels 44 along the fold line 45. These panels 44 are intended to be imprinted with information of a commercial nature or for identifying the source of the containers and their contents as well as to stiffen the carrier.

The view of FIG. 10 shows a paperboard carrier which is a laminated union of the paperboards seen in FIGS. 5 and 6. When the laminated paperboard carrier is applied to a group of six containers, the insertion of the caps C cause the respective tabs 33 of FIG. 5 to blossom out through the aligned apertures 39 in the stiffener ply 38 to allow the cap C to pass through and then the tabs 33 snap back to engage under the neck ring R of each of the containers. In this assembly of a six-pack of containers in a laminated paperboard carrier, the finger grip apertures 31 in ply 30, and finger grip apertures 41 in the stiffener ply 38 are in alignment to form a thick edge for finger comfort.

Figure 11:
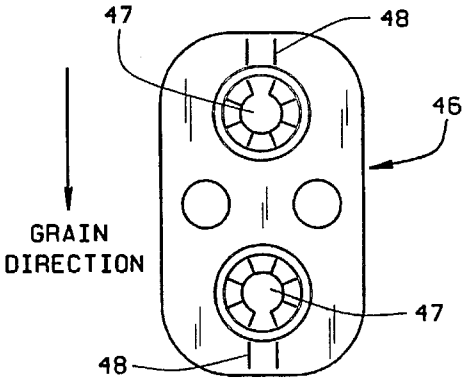
FIG. 11 is a plan view of a two container paperboard carrier.
Figure 12:
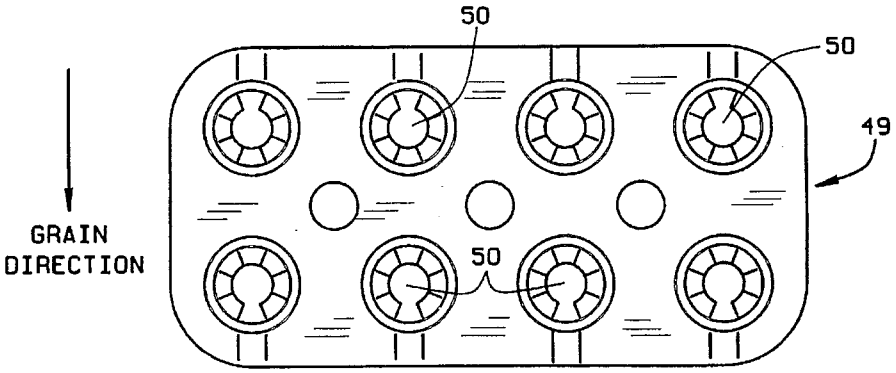
FIG. 12 is a plan view of an eight container paperboard carrier.

The range of application of paperboard carriers having the character of the carriers described in FIGS. 1, 2, 5 and 6 includes paperboard carriers 46 of FIG. 11 for a pair of containers having pull tab means 47 which tear out through the end margins along score lines 48, or paperboard carriers 49 of FIG. 12 for an eight-pack of beverage containers having tear out tabs 50.

Figure 13:
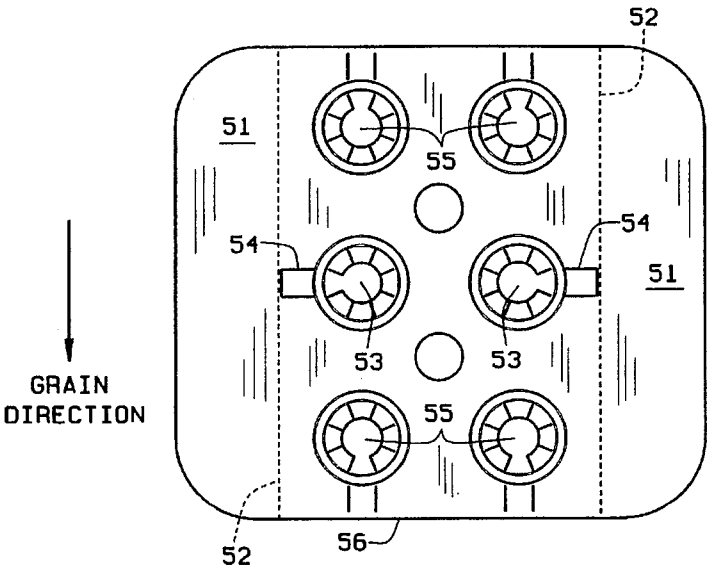
FIG. 13 is a plan view of a modified six container paperboard carrier with side panels which upon folding will greatly increase bending resistance with a full complement of large volume containers.

The view of FIG. 13 repeats the construction of the paperboard carrier in FIG. 1, and adds marginal panels 51 which when folded down along a fold line 52 add considerable stiffness to the carrier for the purpose of carrying heavy containers. Tab means 53 in the center need to be torn out through the U-shaped score lines 54. The other tabs 55 tear out through the margins 56 of the paperboard.

Figure 14:
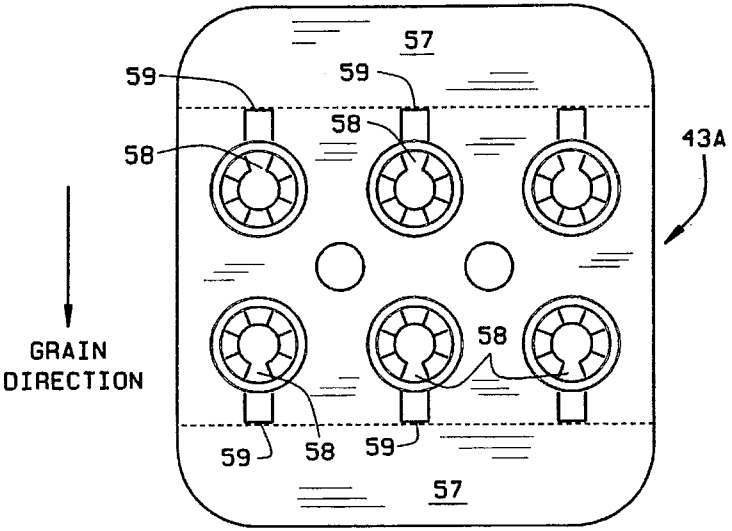
FIG. 14 is another plan view like FIG. 13, but with the tear out tabs being in the grain direction.

Similarly, the paperboard carriers 43 of FIG. 9 is made considerably stiffer by resorting to full width panels 57 shown in the paperboard 43A of FIG. 14 where the grain direction and the pull tabs 58 tear out in the directions of the U-shaped score lines 59.

Figure 15:
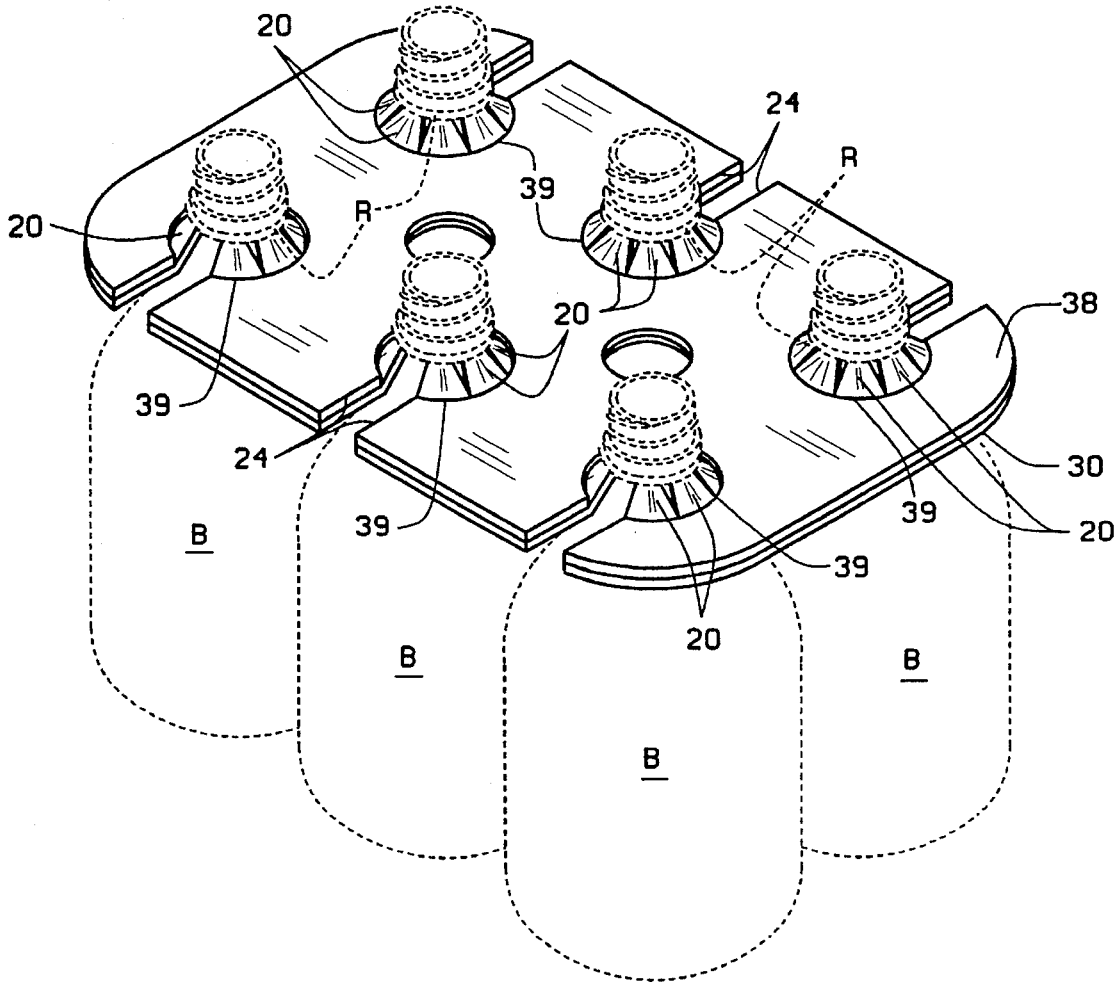
FIG. 15 is a perspective view of a paperboard carrier having the apertures opened to receive empty containers to be recycled.

The view of FIG. 15 illustrates a paperboard carrier in which filled containers had been released therefrom through slots 24 so that empty have been now substituted as shown, for return to a collection station, thereby using the carriers to police the environment of otherwise discarded empty containers.

If the weight ratio of full to empty containers is large, then a modest retention of carrier strength will be adequate to hold empty containers for return as a unit for recycling, deposit refund, etc. It is a reasonable approximation that the more easily a container can be removed, the less the opened carrier aperture can hold, so successful reuse implies a very light dry weight and a considerable full weight. At a minimum, the tear strip must leave something more than 180 degrees of the carrier aperture intact; 270 degrees or a complement of seven tabs 20 or 33 is more likely to be successful in retaining an empty container.

Figure 16:
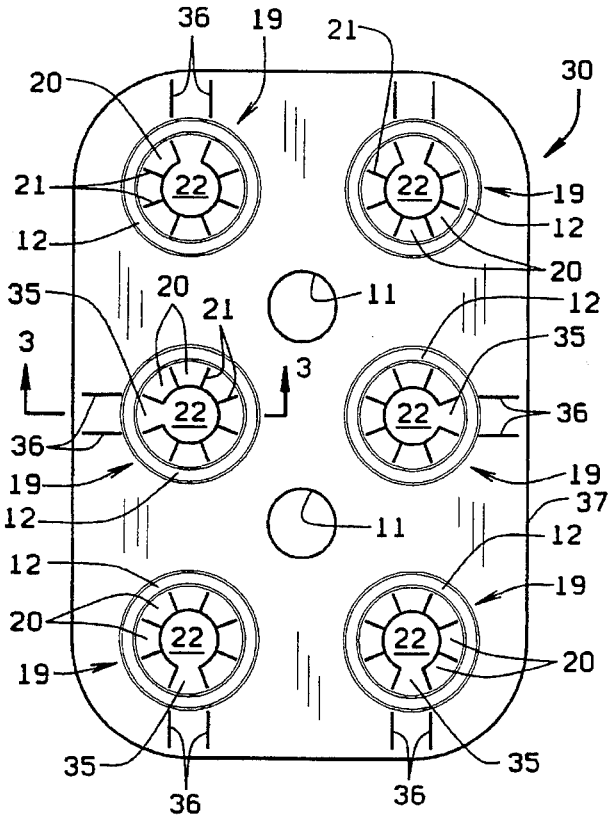
FIG. 16 is a plan view of a carrier for containers in a 6-pack group.
Figure 17:
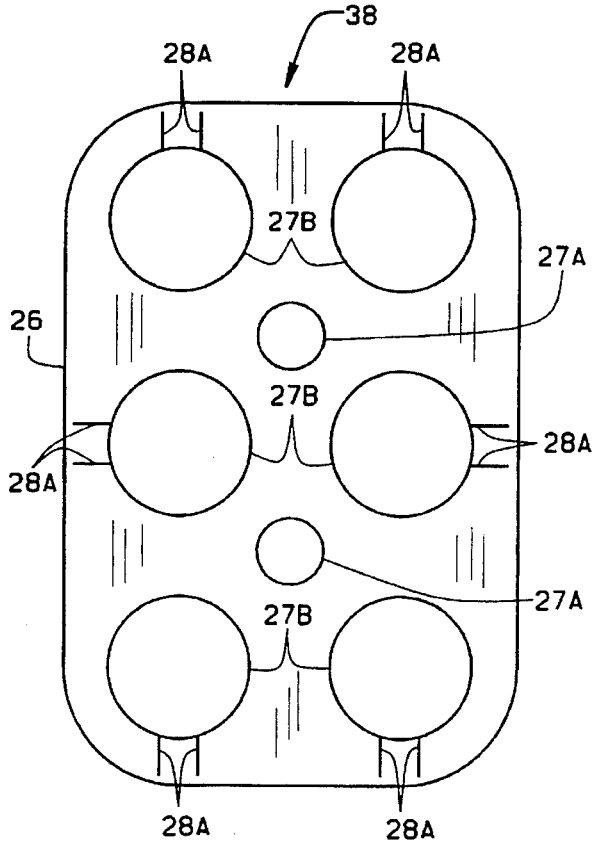
FIG. 17 is a plan view of a paperboard ply for stiffening the carrier of FIG. 16.

In FIGS. 16 and 17 the respective paperboard plies 30 and 38 are repetitive of the paperboard plies 10 and 23 seen in FIGS. 1 and 2 except that the apertures 27B in FIG. 17 are larger in diameter so that when bonded on top of ply 30 of FIG. 16, the appearance of tabs surrounded by circular embossments 12 will be fully exposed. In the view of FIGS. 1 and 2, the apertures 27 in ply 23 will cover the embossments 12 of the ply 10.

Figure 18:
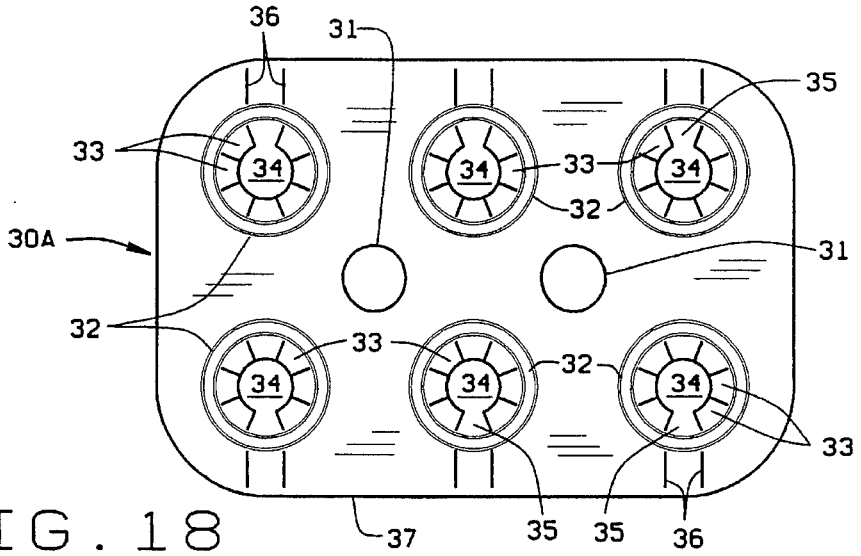
FIG. 18 is a plan view of a carrier with the tabs formed so they can be lifted out of the carrier paperboard ply by tearing out through opposite edges.
Figure 19:
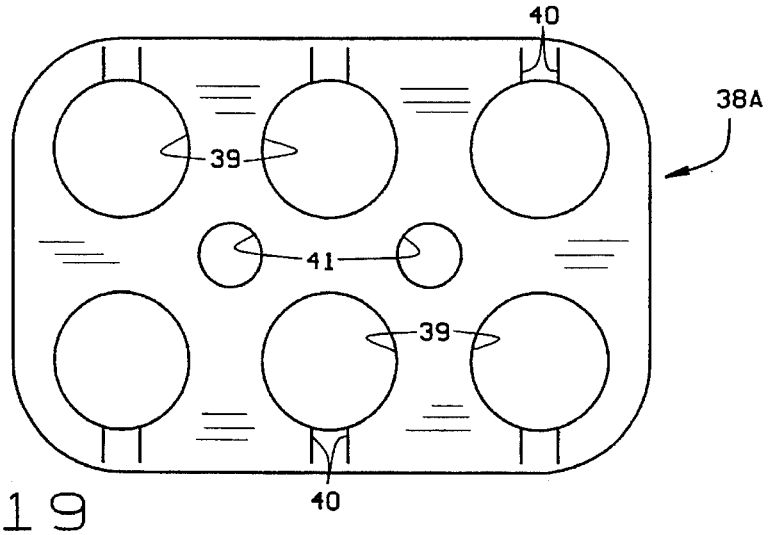
FIG. 19 is a plan view of a paperboard ply for stiffening the carrier ply of FIG. 18.

In a similar manner the apertures 39 in the ply 38A of FIG. 19 are sufficiently large to expose the formation of the tabs 33 and the surrounding embossments 32 when ply 38A is bonded over the ply 30A of FIG. 18. In the release of containers from ply 30A which is bonded to ply 38A, the tabs 34 in ply 30A are capable of tearing out the material between score 40 of ply 38A concurrently with tearing out the material between scores 36 in ply 30A.

Figure 20:
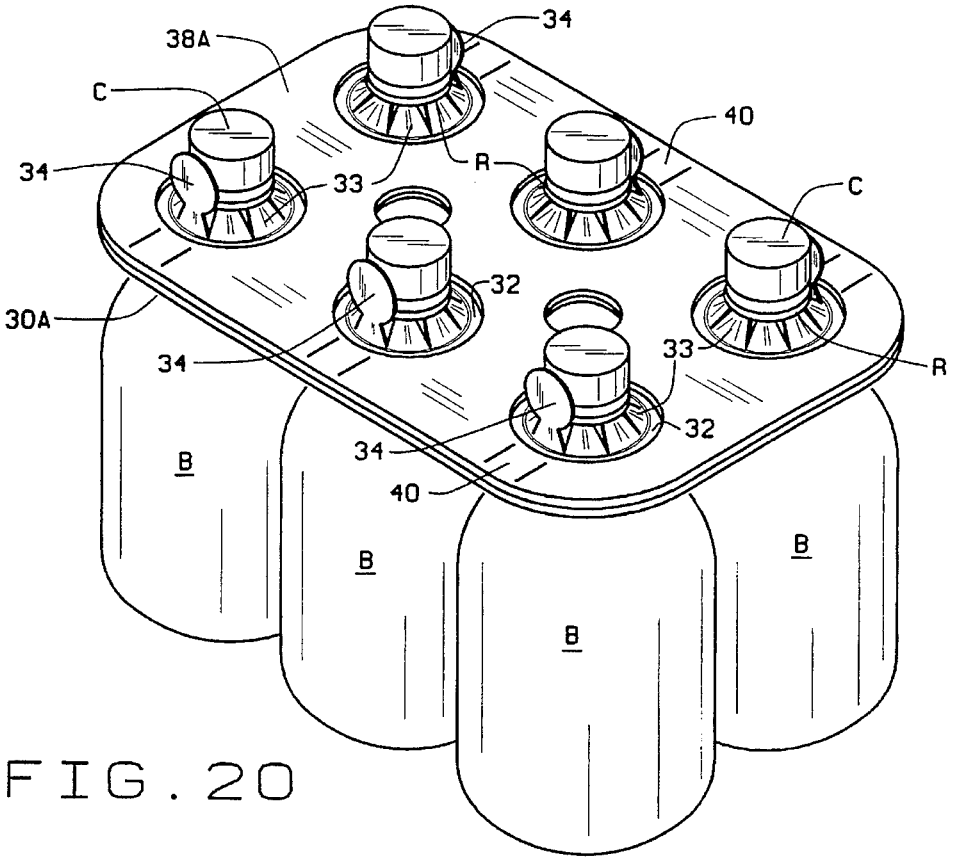
FIG. 20 is a perspective view of a 6-pack of containers in a paperboard carrier to illustrate a typical laminated paperboard carrier construction.

FIG. 20 is a perspective view of a paperboard carrier in which the ply 38A is bonded to the ply 30A so the tabs 33 and 34 are exposed in the apertures 39 and the embossed ring 32 is also exposed.

Figure 21:
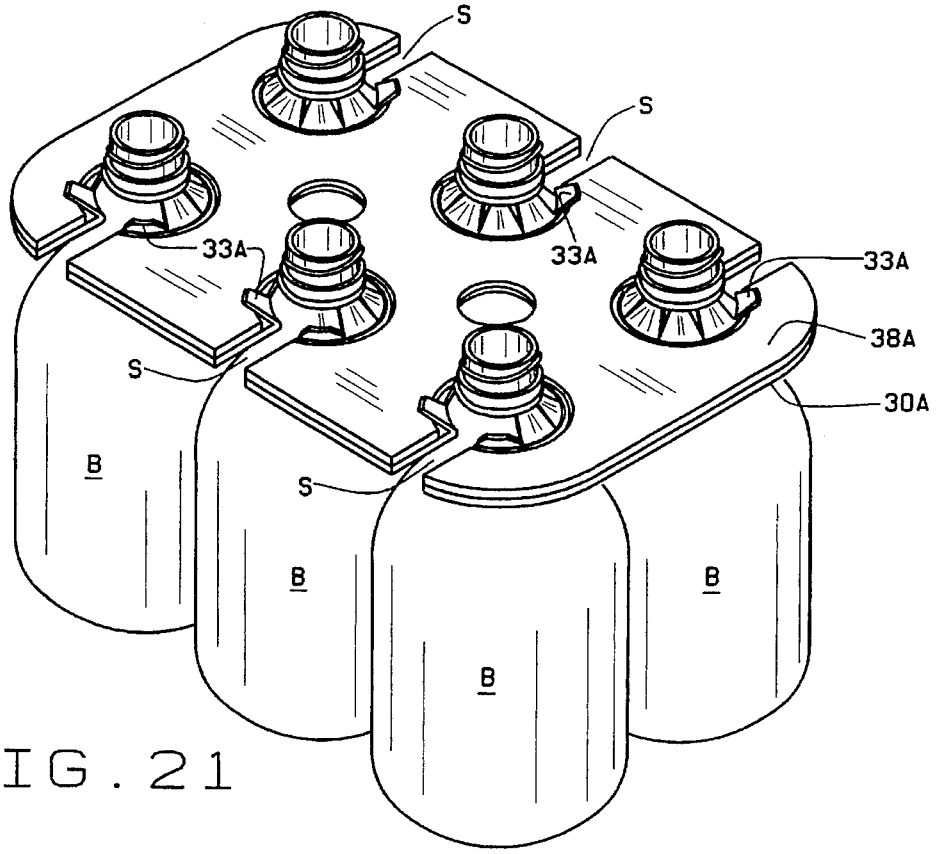
FIG. 21 is a perspective view of a paperboard carrier illustrating empty containers being inserted in the respective apertures.

FIG. 21 is a further perspective view of a paperboard carrier of laminated paperboard plies 30A and 38A in which the apertures for receiving filled containers are opened by bending the tabs 33A at each side of the escape channel S which has been created by pulling on the erected tab 34 (see FIG. 20) which tears out the container escape portion of the paperboard ply 30A between scores 36 (see FIG. 18) and the paperboard ply 38A between scores 40 (see FIG. 19). During the release of the containers B it is necessary to cause the neck or bead portion of the containers to pry or displace tabs 33 out of position in the apertures 39. Empty or used containers B can be pushed through the escape portion of the carrier as illustrated in FIG. 21.

The illustration seen in FIG. 21 shows a paperboard carrier after it has had the containers withdrawn and empty or used containers B returned to the carrier for transportation to a collection area so that the environment is not left in a disorderly condition.

Figure 22:
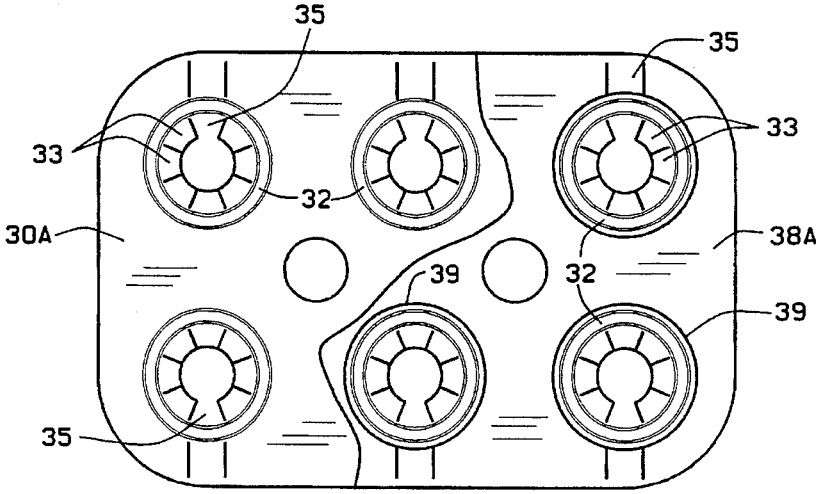
FIG. 22 is a plan view illustrating an exposed carrier ply laminated to a fragmentary portion of a stiffening ply.

FIG. 22 illustrates a paperboard that has a bottom ply 30A bonded to an overlying ply 38A seen in fragmentary plan view. When assembled in this manner the container supporting tabs 33 and 34 surrounded by embossed rings 32 are made visible through the apertures 39.

In the foregoing disclosure the container paperboard carrier material is formed with container receiving apertures spaced inwardly from the marginal edges of the paperboard and sized to engage the filler end of a group of containers by means of a series of tabs directed radially inwardly so as to form a ring around the interior of the apertures, and wherein one of the tabs is formed with an enlarged inner end to form the terminal ends of all of the other tabs, so that when the container filler ends are moved through the apertures in the paperboard carriers all of the tabs are displaced upwardly to form a projecting configuration which surrounds the filler end of the containers for supporting the same. In this arrangement the one tab that is formed with an enlarged inner end is caused to deflect upwardly along with the other tabs, but in this case the enlarged inner end assumes a position alongside the filler end of the containers so as to become a handy device for ripping out the associated tab through the marginal edges of the paperboard carrier to release the associated container filler end. Thus each container can be released from the paperboard carrier one at a time or as is needed.

The characteristics of the paperboard carrier as set forth in the various drawings comprise a flat paperboard sheet having a circular arrangement of tabs delineating apertures for the containers such that the container release tabs assume initial positions substantially closing apertures in the paperboard carrier, with one tab having a specially formed enlarged inner end which becomes the element for tearing out the associated tab from the paperboard carrier for the purpose of releasing the container from the paperboard carrier. In the initial form of the flat paperboard sheet the apertures for the containers are formed by embossed rings surrounding the tabs so as to form hinges for the respective tabs, thereby allowing the tabs to be forced out of the flat paperboard and form a support for the containers with the enlarged end of one of the tabs assuming a convenient position to be torn out of the paperboard when it is desired to release one or more of the containers from the carrier board. In the foregoing structure the tabs are hinged responsive to the insertion of container filler ends with respect to each of the apertures so as to forcibly pivot out of the plane of the paperboard into container supporting positions. The flat sheet of material in this paperboard product is well suited for high-speed manufacture and fast application to containers when assembled with the selected number of containers. The same characteristics apply equally to the flat stiffener ply.

While the carrier is left with partially laterally or side open apertures after all containers are removed, it is contemplated that the empty containers, especially reusable bottles, can be reinserted and will be secure enough to stay in the carrier until returned to the dealer or other designated depository. This feature assists in improving the environment by providing a carrier to remove empty containers in an orderly manner.

The foregoing disclosure has set forth the best mode for carrying the invention into commercial practice, but it is to be understood that variations may come to mind as the character and intent of the invention is understood.

What is claimed is:

1. A paperboard carrier for containers arranged in side-by-side positions and apertures in the carrier each having a closed margin sized to accommodate the filler ends of the containers, said carrier comprising:

a) a flat paperboard sheet having apertures therein for receiving the group of containers having filler ends;

b) a circular arranged group of tabs delineating each aperture, said tabs projecting radially inwardly from outer ends at said closed margin of said aperture, said group of tabs having inner terminal ends forming an open space in said aperture;

c) one of said group of tabs being formed with an enlarged terminal end substantially filling said open space in said aperture;

d) an embossed ring in said carrier surrounding the closed ends of said group of tabs, said embossed ring forming a hingable connection with each of said tabs;

e) score lines formed in said carrier in alignment with said one tab and extending outwardly from said embossed ring to define a tear strip in said carrier sheet; and f) said group of tabs being responsive to the insertion of a container filler end into each of said apertures to forcibly pivot said tabs out of the plane of said carrier to support said container filler ends, said enlarged terminal end of said one tab being positioned along side the filler ends of the containers to be accessible to tear out along said score lines to release the containers from said carrier.

2. The paperboard carrier set forth in claim 1 wherein said paperboard is formed of biodegradable paper.

3. The paperboard carrier set forth in claim 1 wherein said open space formed by the terminal ends of said group of tabs is circular, and said enlarged terminal end of said one tab is circular to fit into said circular open space.

4. The paperboard carrier set forth in claim 1 wherein said flat paperboard sheet has well defined marginal edges and said score lines extend just short of the adjacent marginal edges.

5. The paperboard carrier set forth in claim 1 wherein said sheet is biodegradable and said tear strips render said carrier wildlife friendly.

6. A carrier for closed ended containers arranged in side-by-side positions, the carrier comprising:

a) a flat paperboard sheet embossed with rings defining areas in said flat sheet for the placement of closed ended containers;

b) tab means spaced in side-by-side positions and distributed around in each area defined within said embossed rings and being sufficient in number to fill said areas defined by said rings, each tab means except one having terminal ends to define an aperture in each of said areas within each embossed ring;

c) said one tab means in each of said areas defined within each embossed ring having a terminal end in the form of an enlargement sufficient to close said aperture;

d) said embossed ring forming hinge connections for each of said tab means in each of said areas to permit all of said tab means in said defined areas to project out of said flat paperboard sheet in response to receive the closed ends of said containers; and e) spaced scores in said flat paperboard out side of said embossed ring and aligned with said one tab means in each of said areas, said spaced score lines permitting said one tab means in each of said areas to be torn out of said flat paperboard to release the associated container closed end.

7. In a container carrier of paperboard material having outer boundary edges defining the area of the carrier, and container receiving apertures spaced inwardly from the boundary edges and sized to engage the container beads, the improvement comprising:

a) tab means hingedly formed in the paperboard material and distributed to define a plurality of container receiving apertures;

b) pull tab extensions on one of said tabs in each of said container receiving apertures sized to close said container receiving apertures;

c) score lines extending from each said pull tab extension and extending to an ending spaced from the nearest boundary edges to retain said pull tab extensions in said carrier; and d) hinge means in the paperboard material to allow for elevating all of said tab means, as well as said pull tab in response to the insertion of containers in receiving apertures of the carrier.

8. A method of constructing a paperboard carrier for containers utilizing a flat paperboard sheet having marginal edges defining the area limits of the sheet, the method including:

a) delineating small areas spaced apart in the sheet to receive containers;

b) preparing each delineated small area with a ring of tabs having forms projecting radially inwardly from outer ends in a circular relationship to inner ends defining a small area substantially concentric with the outer circle;

c) selecting one of said tabs to terminate at its inner end with an enlarged surface filling the smaller concentric area;

d) forming hinging connections at the outer end of the ring of tabs including the selected one of the tabs;

e) forming score lines directed from alignment with said selected one of said tabs and extending from the hinging connection at the outer end of the selected one of said tabs toward the marginal limits of the sheet; and f) severing said tabs from each other and from said selected one of said tabs whereby insertion of a container in each delineated small area forces said tabs to blossom out of the flat sheet and the enlarged surface to project above the flat surface.

9. A method of constructing a paperboard carrier for containers utilizing a flat paperboard sheet as set forth in claim 8 wherein the forming of said radially inwardly projecting tabs in a circular relationship to inner ends to define a circle, and the selection of one of said tabs to terminate at an inner end filling the circle defined by the inwardly projecting tabs results in the reduction in formation of paperboard scrap.

10. A paperboard carrier for packaging containers arranged in side-by-side positions and apertures in the carrier each having a closed margin sized to accommodate the filler ends of individual containers, said carrier comprising:

a) flat paperboard carrier having a circular array of tabs for receiving and supporting groups of containers from the filler ends, said array of tabs having base ends delineating container receiving apertures, said tabs projecting radially inwardly from the base ends to inner terminal ends forming circular open spaces in said apertures;

b) one of said tabs in each of said array of tabs being formed with an inner terminal end occupying said circular open space in said apertures;

c) an embossed ring in said flat paperboard carrier surrounding the base ends of said array of tabs, said embossed ring forming a hingable connection for the base ends of said tabs;

d) score lines formed in said paperboard carrier in alignment with said one tab and extending outwardly from said embossed ring to define tear-out strips in said paperboard carrier; and e) said array of tabs being responsive to the insertion of a container filler end into each of said array of tabs to forcibly pivot said tabs out of the paperboard carrier to support the container filler ends, said enlarged terminal end of said one tab pivoting into position alongside the filler end of the containers to be accessible as a handle to tear out said one tab from the paperboard along said score lines to form a container release path from said carrier.

11. The paperboard carrier set forth in claim 10 wherein said paperboard is formed of biodegradable paper.

12. The paperboard carrier set forth in claim 10 wherein said open space formed by the terminal ends of said array of tabs is circular, and said enlarged terminal end of said one tab is circular to fit into said circular open space.

13. The paperboard carrier set forth in claim 10 wherein said flat paperboard has well defined marginal edges and said score lines extend from said embossed rings to just short of the adjacent marginal edges.

14. The paperboard carrier set forth in claim 10 wherein said paperboard tear-out strips render said carrier wildlife friendly.

15. A carrier for closed ended containers arranged in side-by-side positions, the carrier comprising:

a) a flat laminated paperboard sheet embossed with rings defining areas in said sheet for the placement of closed ended containers;

b) tab means spaced in side-by-side positions and distributed around in each area defined within said embossed rings and being sufficient in number to fill said areas defined by said embossed rings, each tab means except one having base ends at said embossed rings and terminal ends which define an opening in each of said areas within each embossed ring;

c) said one tab means in each of said areas defined within each embossed ring having a base end at said embossed ring and an inner terminal end in the form of an enlargement sufficient to fit in said opening, in said areas within each embossed ring;

d) said embossed rings forming hinge connections for said base ends of each of said tab means in each of said areas to permit all of said tab means in said defined areas to be projected out of said paperboard sheet to create a conic support to receive the closed ends of said containers; and e) spaced scores in said flat paperboard outside of each said embossed ring and aligned with said one tab means in. each of said areas, said spaced score lines permitting said one tab means in each of said areas to define a tear-out strip in said paperboard between said score lines to release the associated container closed end.

16. In a carrier for containers having filler end closures and bead formations adjacent each filler end, the container carrier consisting of paperboard material having outer boundary edges defining the respective sides defining the area of the carrier, and container receiving apertures spaced inwardly from the boundary edges and sized to engage the container bead formations, the improvement comprising:

a) tab means hingedly formed in the paperboard material and distributed to define a plurality of container supports in the container receiving apertures;

b) pull tab extensions on one of said tabs in each of said container receiving apertures sized to fit into said container receiving apertures;

c) score lines extending from said pull tab to an ending spaced from the nearest boundary edges to retain said pull tab extensions in said carrier; and d) hinge means in the paperboard material to allow for elevating said tab means into container bead supports, as well as elevation of said pull tab in response to the insertion of containers in receiving apertures of the carrier.

17. The carrier set forth in claim 16 wherein side panels are bendably attached to opposite boundary edges of the paperboard material for stiffening the carrier, said container receiving apertures located adjacent said opposite sides having container release score lines extending between said container receiving apertures and said bendable attachment of said side panels.

18. A paperboard carrier for containers having filler end closures and bead formations adjacent the filler end closures, the carrier comprising:

a) laminated paperboard sheets having a first paperboard sheet bonded to a second paperboard sheet; said bonded sheets having outer margins defining the area limits of said carrier;

b) said first paperboard sheet being formed with spaced apart circular embossed rings each surrounding a plurality of tab elements which project radially inwardly from said embossed rings to terminal ends surrounding openings in said first paperboard sheet;

c) one of said tab elements having an enlarged terminal end disposed in said opening in said first paperboard sheet;

d) said second paperboard sheet being formed with spaced apart apertures having circular rims aligned to register with said embossed rings, said apertures exposing said tab elements to view in said first paperboard sheet through said registered apertures;

e) radially directed score lines formed in said first and second paperboard sheets to be in overlying registration and aligned to extend from a position adjacent said embossed ring opposite said one tab element having said enlarged terminal end to outer ends adjacent said outer margin of the carrier; and f) all of said tab elements in said first paperboard sheet being hingedly displacable by a container pressed against said tab elements to force said tab elements to project through said apertures in said second paperboard sheet to engage with the container bead formation, said one tab element projecting its enlarged terminal end into position to effect tearing out said laminated paperboard sheets along said aligned score lines and container release from said carrier.

19. The paperboard carrier set forth in claim 18 wherein said plurality of tab elements are formed to be integral with said embossed rings.

20. The paperboard carrier set forth in claim 18 wherein said circular rims of said apertures in said second paperboard sheet register outside said embossed rings to expose said latter rings for hinging displacement of said tab elements.

21. The paperboard carrier set forth in claim 18 wherein said displacement of said tab elements through said apertures in said second paperboard sheet assume positions constituting a conic configuration supporting container bead formations.

* * * * *